US006279197B1

(12) United States Patent
Crutcher et al.

(10) Patent No.: US 6,279,197 B1
(45) Date of Patent: Aug. 28, 2001

(54) DUCTWORK CLEANING SYSTEM

(75) Inventors: J. Dudley Crutcher, Dunedin, FL (US); Pat Hyland, Bedford; Scott Peterson, Ennis, both of TX (US); Craig Smith, Atlanta, GA (US)

(73) Assignee: Rotobrush, Carrollton, TX (US)

( * ) Notice: Subject to any disclaimer, the term of this patent is extended or adjusted under 35 U.S.C. 154(b) by 0 days.

(21) Appl. No.: 09/478,784

(22) Filed: Jan. 6, 2000

(51) Int. Cl.[7] ..... A47L 9/24; A47L 7/02

(52) U.S. Cl. ..... 15/383; 15/389; 15/392; 15/395; 15/304

(58) Field of Search ..... 15/304, 383, 389, 15/392, 395, 415.1; 16/2.1

(56) References Cited

U.S. PATENT DOCUMENTS 4,535,196 * 8/1985 Milne ..... 16/2.1
4,792,363 * 12/1988 Franklin, Jr. et al. ..... 15/383
4,984,329 * 1/1991 Wade ..... 15/387
5,074,007 * 12/1991 Mai et al. ..... 15/344
5,109,567 * 5/1992 Harrison ..... 15/345
5,167,047 * 12/1992 Plumley ..... 16/2.1
5,608,941 * 3/1997 Kleinfeld ..... 15/383
5,806,140 * 9/1998 Carlson et al. ..... 16/2.1
5,813,089 * 9/1998 Nolan et al. ..... 15/383
5,862,568 * 1/1999 Sjöberg ..... 15/304

* cited by examiner

*Primary Examiner*—Robert J. Warden, Sr.
*Assistant Examiner*—Theresa T. Snider
(74) *Attorney, Agent, or Firm*—Lieberman & Nowax, LLP

(57) ABSTRACT

An accessory system for a ductwork cleaning machine that utilizes a vacuum hose having a rotating cleaning brush the vacuum and the power for the rotating brush being supplied from a remote power unit with a rotating drive cable being located within the vacuum hose. The accessories permit more efficient operation of the ductwork cleaning system. The first accessory is an improved nozzle for mounting the rotating brush which permits large vacuum openings without the risk of an operator becoming entangled with the rotating cable. A second accessory prevents the cable from withdrawing within the vacuum hose when the hose is disconnected from the power unit. The third to accessory is attached to the power unit and guides the guide cable into place as the vacuum hose is attached to the power unit.

9 Claims, 2 Drawing Sheets

FIG. 3
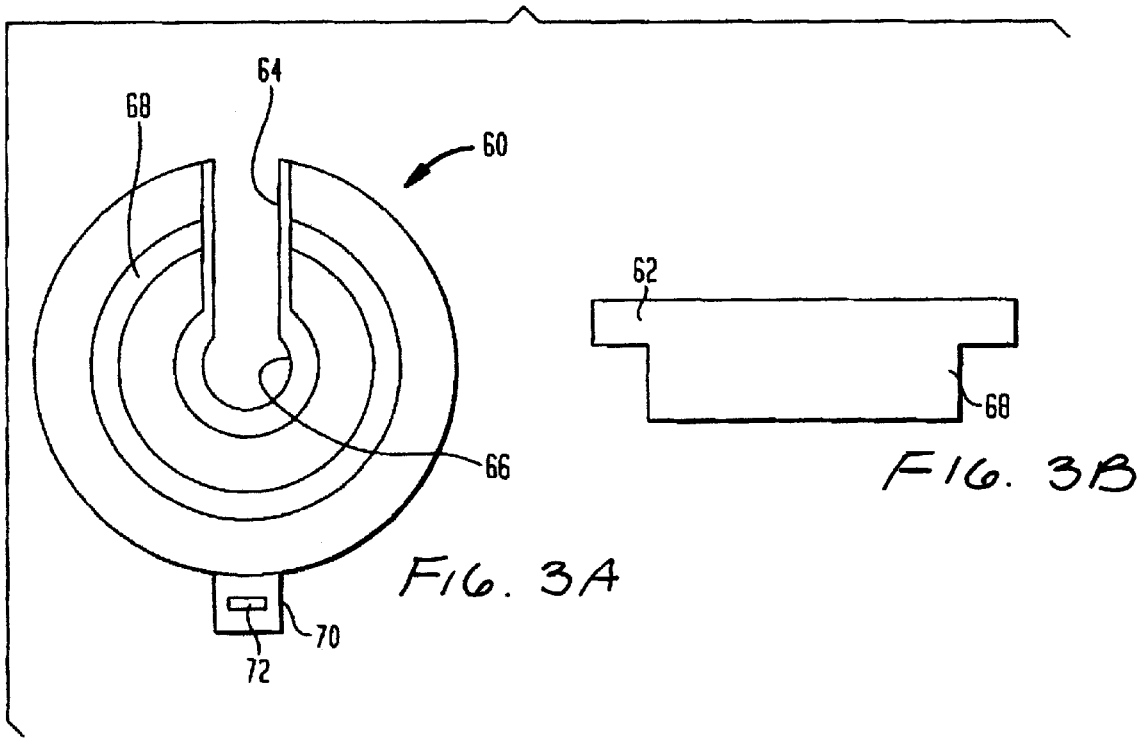
FIG. 3A
FIG. 3B
FIG. 4
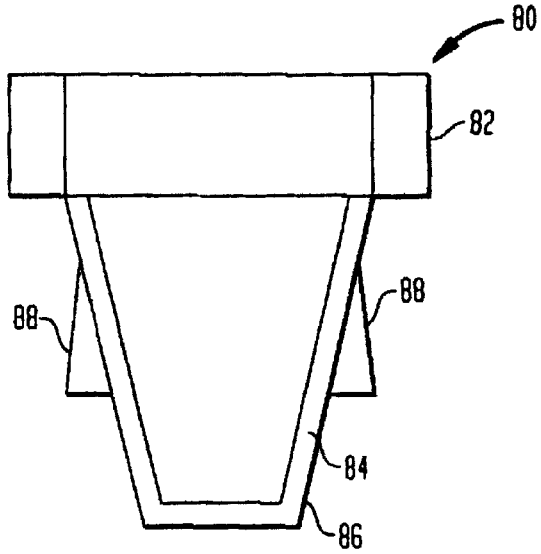

DUCTWORK CLEANING SYSTEM

BACKGROUND AND SUMMARY OF THE INVENTION

The present invention relates to improvements in accessories for rotary vacuum ductwork cleaning systems.

Modern buildings contain many feet (or miles) of ductwork for the HVAC (heating, ventilation, air-conditioning) system. This ductwork moves many cubic feet of air through it, often 24 hours a day, seven days a week. In addition to the air flowing through the ductwork the ductwork can contain many contaminants such as dust, fibers, pollen, hair and the like. The filtering systems used are generally unable to remove all of the contaminants from the ductwork so that regular cleaning of the ductwork itself is required.

In order to clean such ductwork, various cleaning systems have been developed. One such system which has been found to be particularly efficient is a system which utilizes a vacuum hose through which a flexible rotating cable is run. The flexible cable runs concentrically within the vacuum hose and is attached to a soft bristled brush coupled to the flexible rotating cable at the intake opening of the vacuum hose. A drive motor for rotating the flexible cable and a vacuum motor for providing a source of air flow and removing the dust picked up by the brush is located in a central power unit. An example of such equipment is illustrated in U.S. Pat. No. 4,792,363 which issued on Dec. 20, 1988 and is entitled "Vent Cleaning System." The disclosure of this patent is hereby incorporated by reference as if fully set forth herein.

The vacuum hose which has the rotary cable mounted within it is typically 35 feet, and the vacuum hose and the drive cable can slide within each other so that the drive cable becomes withdrawn within the vacuum hose, which requires the operator to retrieve the drive cable, which can be difficult when the cable withdraws fully within the vacuum hose. This typically occurs during transport of the cable and hose assembly separate from the power unit. When the cable withdraws into the hose, significant and valuable time is lost retrieving the cable, and damage to surrounding items is possible due to the aggressive retrieval method required. The present invention is directed to equipment designed to ease the handling of the vacuum hose and its drive cable to maximize the uptime of the ductwork cleaning system.

Another means for increasing the usefulness of this type of equipment is to increase its cleaning efficiency. This can be accomplished by increasing the amount of air that can flow through the vacuum hose. The equipment shown in the above-described US Patent has relatively small air intake openings at the rotating brush end which limits the amount of air (and contaminants) that can be drawn through the vacuum hose. This limits the efficiency of the ductwork cleaning machine and may also cause clogging of the intake openings. However, merely increasing the size of the inlet openings can be unsafe to the operator due to the presence of the rotating cable used to power the rotating brush. The rotating cable, if left in the open, can snag fingers or clothing, particularly at close quarters. The present invention is also directed to an improved nozzle for the vacuum hose and rotating brush which greatly increases vacuum volume but prevents the operator from being entangled by the rotating cable.

The present invention is also directed to accessories which can easily maintain the vacuum hose and cable when it is being attached to the power unit such that the equipment can be set up and taken down quickly and efficiently.

The present invention is directed to an accessory system for ductwork cleaning machines that utilize a vacuum hose having a rotating cleaning brush, the vacuum and the power for the rotating brush being supplied from a remote power unit. The accessories permit more efficient operation of the ductwork cleaning system. The first accessory is an improved nozzle for mounting the rotating brush which permits large vacuum openings without the risk of an operator being entangled within the rotating cable. A second accessory prevents the cable from withdrawing within the vacuum hose when the hose is disconnected from the power unit. The third accessory is attached to the power unit and guides the drive cable into place as the vacuum hose is attached to the power unit.

BRIEF DESCRIPTION OF THE DRAWINGS

For better understanding of the invention references made to the following drawings which are to be taken in conjunction with the detailed specification to follow:

FIGS. 3A and 3B are plan and side views of the cable retention accessory in accordance with the present invention; and FIG. 4 is a sectional view of the cable guide for attachment to the power unit of the ductwork cleaning system.

DESCRIPTION OF THE PREFERRED EMBODIMENTS

Figure 1:
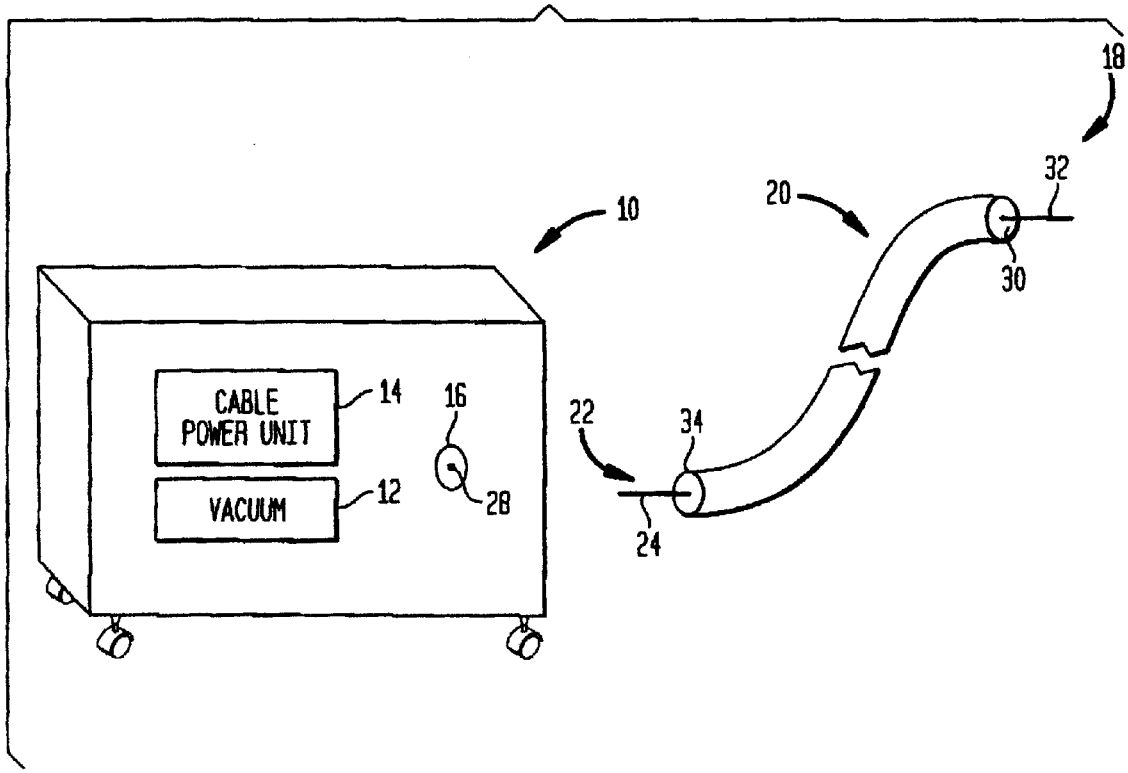
FIG. 1 is an overall view of a ductwork cleaning system in which a rotary cable for rotating a rotary brush is concentrically mounted within a vacuum hose in which the cable accessories of the present invention are adapted.

The power unit 10 of the ductwork cleaning system is shown in FIG. 1 and includes within it a vacuum motor 12 and a motor 14 for driving the rotating cable used to rotate a cleaning brush 18. A hose coupling 16 is used to couple a vacuum hose 20 to power unit 10. Disposed within a vacuum hose 20 is a flexible cable 22 which has a proximal end 24 having a connector for coupling to a connector 28 of power unit 10. The distal end 30 of cable 22 has a connector 32 for connection to brush 18. The proximal end 34 of vacuum hose 20 is coupled via a threaded coupling to hose coupling 16 of power unit 10.

In operation, drive motor 14 of power unit 10 rotates coupling 28 which is connected to cable 22 running concentrically within vacuum hose 20. As cable 22 is connected to brush 18 at the distal end of hose 10, it will be rotated as well. Vacuum motor 12 of power unit 10 causes a flow of air to be drawn through hose 20 such that dust particles dislodged through the rotation of brush 18 will enter openings located proximate to brush 18 and will be drawn through hose 20.

Figure 2:
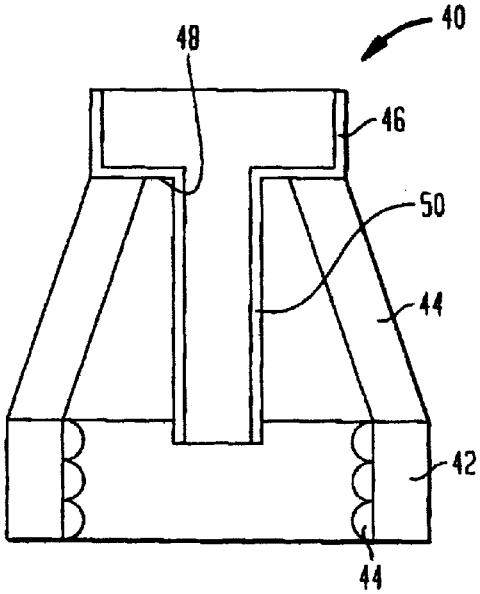
FIG. 2 is a sectional view of a nozzle unit in accordance with the present invention.

The present invention provides accessories which improves the cleaning efficiency and ease of use of the ductwork cleaning system described above. The first of these accessories is a nozzle unit 40 shown in FIG. 2 which includes an annular collar 42 which includes internal threads 44 for attachment to mating threads at the distal end of hose 20. Spaced apart from collar 42 by means of a series of three supports 44 which extend around the periphery of collar 42 is a collar 46 for receiving a bushing which is joined to rotating brush 18. Collar 46 includes a lower wall which has a central circular opening 48 through which drive cable 22 will pass. Joined to the bottom of lower wall 47 of collar 46 is a tubular sleeve 50 through which drive cable 22 will be inserted. Sleeve 50 extends to below the upper surface of collar 42 which means that sleeve 50 will extend to within hose 20, this provides that drive cable 22 will not be exposed and thus cannot be entangled with the operator or the operator's clothing. As the entire area between collars 42 and 46 is open, with the exception of the small amount of space taken up by supports 44, the amount of air that can be drawn through the nozzle is greatly increased without compromising operator safety. In addition, the large vacuum openings provided by nozzle unit 40 will not become clogged which is a concern with nozzles having smaller openings.

During transport of the equipment, when hose 20 is removed from power unit 10, cable 22 may withdraw within hose 20 as hose 20 is coiled. If cable 22 retreats within hose 20 the operator must spend time retrieving it, which is inefficient. FIG. 3 illustrates a cable retainer 60 which prevents cable 22 from withdrawing within hose 20. Cable retainer 60 includes a disc 62 which is of a diameter approximately equal to that of the outer diameter of hose 20. Disc 62 includes a slot 64 leading to a central circular opening 66 for receiving cable 22. The walls of slot 64 are slightly diverging so as to guide cable 22 towards opening 66. The underside of disc 62 includes a peripheral rim 68 which will fit within the opening of hose 20. Disc 62 also includes a tab 70 having an opening 72 to permit cable retainer 60 to be grasped by the operator.

In use the operator, after disconnecting hose 20 from power unit 10, places cable retainer 60 onto the power unit end of hose 20 by inserting cable 22 within slot 64 to opening 66 which will retain cable 22 and rim 68 is then inserted into the end of hose 20. This will prevent cable 22 from retreating within hose 20 during transport and permit easy reconnection of hose 20 to power unit 10 during set up by simply removing cable retainer 62 and thereafter attaching cable 22 to power unit 10.

FIG. 4 illustrates a cable guide 80 which also assists the operation of the ductwork cleaning apparatus by guiding cable 22 for attachment to power unit 10. Cable guide 80 includes a collar 82 that fits within hose coupling 16 of power unit 10. Cable guide 80 includes a conical portion 84 that converges towards an opening 86 that is just slightly larger than the outer diameter of drive cable 22. Disposed at the outer periphery of conical portion 84 are a series of vanes 88 which will provide an interference fit within hose coupling 16 of power unit 10. In use, cable guide 80 is inserted within coupling 16 of power unit 10 so that collar 82 is located within the inner diameter of hose coupling 16 with vanes 88 providing centering and a tight fit. Cable guide 80 will then be retained within hose coupling 16 without interference for the attachment of vacuum hose 20. Upon coupling of vacuum hose 20 which carries drive cable 22 to power unit 10, drive cable 22 will be guided by conical portion 84 towards coupling 28 within power unit 10. This occurs without the possibility of the operator having to manually hold cable 22 in position as it and vacuum hose 10 are attached. As cable guide 80 fits within hose coupling 16, once inserted it can remain there permanently.

All of the ductwork cleaning accessories described herein can be readily manufactured by molding as a single unitary moldment. A suitable material for each accessory is a resilient plastic such as vinyl (polyvinyl chloride) which has a resilience which assists in the retention of the cable and/or the attachment of the accessory to the hose or power unit. The accessories can be used with small or large diameter hoses as their design is readily scalable.

The invention has been described with respect to preferred embodiments. However, as those skilled in the art will recognize, modifications and variations in the specific details which have been described and illustrated may be resorted to without departing from the spirit and scope of the invention as defined in the attached claims.

What is claimed is:

1. In a ductwork cleaning system having a central unit providing a source of vacuum and means for rotating a drive shaft, with a flexible vacuum hose for delivering a vacuum to the duct to be cleaned, said flexible vacuum hose having a concentric flexible drive shaft contained therein and a rotating brush disposed at one end of the flexible vacuum hose, the improvement comprising:

a) a nozzle unit having a first collar having means for attachment to the one end of the vacuum hose;

b) a second collar spaced apart from said first collar for receivably mounting the rotating brush;

c) a sleeve for rotatably mounting the flexible drive shaft for the brush, said sleeve being joined to said second collar and extending to said first collar;

d) spacers for positioning said first collar apart from said second collar and openings for the vacuum being defined between the first and second collar.

2. The ductwork cleaning system as claimed in claim 1 wherein said first collar, said second collar, said sleeve and said spacers are constructed as a single element.

3. The ductwork cleaning system as claimed in claim 1 wherein said attachment means of said first collar comprise threads.

4. In a ductwork cleaning system having a power unit providing a source of vacuum and means for rotating a drive shaft and having a coupling for attaching a vacuum hose thereto with a flexible drive shaft concentrically disposed therein, the improvement comprising: a cable guide, said cable guide including a collar constructed and arranged to fit within the coupling of the power unit, a conical portion attached to said collar and tapering towards an opening for receiving and guiding said flexible drive shaft to a drive shaft coupling.

5. The ductwork cleaning system as claimed in claim 4 further including vanes disposed on the outside of said conical portion for providing an interference fit within said coupling.

6. The ductwork cleaning system as claimed in claim 4 wherein said collar is a unitary element constructed from resilient plastic.

7. In a ductwork cleaning system having a vacuum hose having disposed therein a flexible rotating cable for rotating a cleaning brush, the improvement comprising: a cable retainer, said cable retainer having a disc of a diameter approximately equal to that of said vacuum hose, a rim mounted to said disc for insertion into an end of said vacuum hose, a central opening disposed in said disc and a slot extending from the edge of said disc into said opening, said opening being constructed and arranged to receive said cable when said disc is inserted within the end of said hose.

8. The ductwork cleaning system as claimed in claim 7, wherein the walls of said slot diverge from said central opening.

9. The ductwork cleaning system as claimed in claim 7, wherein said cable retainer is molded from a resilient plastic.

* * * * *